US008464376B1

(12) United States Patent
Waite

(10) Patent No.: US 8,464,376 B1
(45) Date of Patent: Jun. 18, 2013

(54) COVER FOR A PILLOW OR CUSHION

(75) Inventor: Carmen Waite, Charlotte, NC (US)

(73) Assignee: Perfect Fit Industries, LLC, Charlotte, NC (US)

( * ) Notice: Subject to any disclaimer, the term of this patent is extended or adjusted under 35 U.S.C. 154(b) by 0 days.

(21) Appl. No.: 13/530,264

(22) Filed: Jun. 22, 2012

(51) Int. Cl.
*A47G 9/02* (2006.01)
*A47G 9/10* (2006.01)

(52) U.S. Cl.
USPC ..... 5/490; 5/485; 5/636

(58) Field of Classification Search
USPC ..... 5/490, 499, 501, 485, 482, 636
See application file for complete search history.

(56) References Cited

U.S. PATENT DOCUMENTS

| | | | | | |
|---|---|---|---|---|---|
| 880,524 | A | * | 3/1908 | Hauphoff | 5/490 |
| 1,349,258 | A | * | 8/1920 | Blocksom | 5/490 |
| 2,066,252 | A | * | 12/1936 | Cohen, Jr. | 5/499 |
| 2,179,175 | A | * | 11/1939 | Cohen, Jr. | 5/499 |
| 2,446,396 | A | | 8/1948 | Waranch | |
| 2,759,200 | A | * | 8/1956 | Johnston | 5/490 |
| 2,895,146 | A | * | 7/1959 | Lester | 5/490 |
| 3,044,517 | A | * | 7/1962 | Levi | 150/158 |
| 3,109,474 | A | * | 11/1963 | Levi | 150/158 |
| 3,241,161 | A | * | 3/1966 | Dashosh | 5/501 |
| 3,974,531 | A | | 8/1976 | Van Pelt | |
| 4,480,346 | A | | 11/1984 | Hawkins et al. | |
| 5,070,558 | A | | 12/1991 | Fenley | |
| 5,084,928 | A | | 2/1992 | Skillington | |
| 5,321,861 | A | * | 6/1994 | Dancey et al. | 5/482 |
| 5,363,523 | A | | 11/1994 | Blackburn | |
| 5,642,540 | A | * | 7/1997 | Culver et al. | 5/499 |
| 5,652,983 | A | | 8/1997 | Kraemer | |
| 5,727,266 | A | | 3/1998 | Pang | |
| 5,787,527 | A | * | 8/1998 | Anderson | 5/484 |
| 5,940,909 | A | * | 8/1999 | Sapp | 5/490 |
| 6,067,677 | A | | 5/2000 | Reen et al. | |
| 6,253,398 | B1 | * | 7/2001 | Yim | 5/499 |
| 6,427,268 | B1 | * | 8/2002 | Davis | 5/490 |
| 6,910,237 | B2 | | 6/2005 | DiGirolamo | |
| 6,971,128 | B1 | * | 12/2005 | McGrath | 5/490 |
| 7,578,014 | B1 | | 8/2009 | Rodriguez | |
| 7,856,689 | B2 | * | 12/2010 | Habimana | 5/655 |
| 2006/0282951 | A1 | | 12/2006 | Hall et al. | |
| 2008/0263767 | A1 | | 10/2008 | Mooney | |
| 2010/0154120 | A1 | | 6/2010 | Heumann | |
| 2010/0319126 | A1 | | 12/2010 | Craib | |

* cited by examiner

*Primary Examiner* — Robert G Santos
(74) *Attorney, Agent, or Firm* — Panitch Schwarze Belisario & Nadel LLP

(57) ABSTRACT

A cover for a pillow or cushion includes a first panel and a second panel. At least a portion of an outer periphery of the second panel is secured to at least a corresponding portion of an outer periphery of the first panel to form a cavity therebetween. A flap extends from a portion of the outer periphery of one of the first and second panels toward the cavity. First and second lateral edges of the flap are secured to a portion of the outer periphery of at least one of the first and second panels. At least one fastener is located proximate to the free edge of the flap. The fastener biases or holds the flap toward the interior surface of one of the first and second panels to at least partially surround and secure one of a pillow and a cushion within the cavity.

13 Claims, 4 Drawing Sheets

COVER FOR A PILLOW OR CUSHION

BACKGROUND OF THE INVENTION

The present invention relates generally to a cover for a pillow or cushion, and, more particularly, to a pillow case that securely holds and/or retains a pillow within a cavity thereof.

Covers for pillows or cushions, and particularly pillow cases, are well known. Conventional covers are typically formed from a cloth and may serve the dual role of being protective and decorative. Certain conventional covers are also completely removable from the encased pillow or cushion, which permits laundering of the cover without the pillow or cushion.

Although conventional covers are quite acceptable and useful, conventional covers have a tendency to be inadvertently removed from the enclosed pillow or cushion. Conventional covers also have a tendency to become inadvertently misaligned or skewed with respect to the enclosed pillow or cushion, which can cause irritation to a user. Such inadvertent removal and/or misalignment often occurs after numerous and/or repeated uses of the cover, such as after a full night sleep by a user that moves or turns-over frequently and/or after the material used to form the cover begins to stretch, pull or otherwise expand. Further, conventional covers tend to be undesirably easily removed from the encased pillow or cushion when the combined covering and pillow are hastily thrown or tossed.

Therefore, it would be desirable to provide a cover for a pillow or cushion that is capable of readily securing the pillow or cushion within a cavity thereof. More particularly, it would be desirable to provide a fastener on or within the covering to secure at least a portion of the pillow or cushion therein. It would also be desirable if the fastener imparted force on the pillow or cushion in more than one plane or direction, which would make it less likely that the cover would be inadvertently removed and/or misaligned with respect to the encased pillow or cushion. The device of the present disclosure accomplishes the above-identified objectives.

BRIEF SUMMARY OF THE INVENTION

Briefly stated, one aspect of the present invention is directed to a cover for a pillow or cushion having a generally planar first panel with an exterior surface and an opposing interior surface and a generally planar second panel which has an exterior surface and an opposing interior surface. At least a portion of an outer periphery of the second panel is secured to at least a corresponding portion of an outer periphery of the first panel to form a cavity between the interior surface of the first panel and the interior surface of the second panel. A flap extends from a portion of the outer periphery of one of the first and second panels toward the cavity. The flap includes a first lateral edge, an opposing second lateral edge and a free edge extending from the first lateral edge to the second lateral edge. Each of the first and second lateral edges of the flap are secured to a portion of the outer periphery of at least one of the first and second panels. At least one fastener is located proximate to the free edge of the flap. The fastener biases or holds the flap toward the interior surface of one of the first and second panels to at least partially surround and secure one of a pillow and a cushion within the cavity.

In other aspect, the present invention is directed to a cover for a pillow or cushion having a generally planar first panel with a first end edge, an opposing second end edge, a first lateral edge, an opposing second lateral edge, an exterior surface and an opposing interior surface. The first panel is formed of a non-elastic, woven or knit material. A generally planar second panel has a first end edge, an opposing second end edge, a first lateral edge, an opposing second lateral edge, an exterior surface and an opposing interior surface. The entire first end edge of the second panel is secured to the entire first end edge of the first panel. The entire first lateral edge of the second panel is secured to the entire first lateral edge of the first panel. The entire second lateral edge of the second panel is secured to the entire second lateral edge of the first panel. The second panel is formed of a non-elastic, woven or knit material. A cavity is formed between the interior surface of the first panel and the interior surface of the second panel. An opening is formed between the second end edge of the first panel and the second end edge of the second panel for accessing the cavity. A flap includes a first lateral edge, an opposing second lateral edge, a free edge extending from the first lateral edge to the second lateral edge and an opposing attached edge. The entire attached edge of the flap is integral with or secured to the second end edge of one of the first and second panels. The entire first lateral edge of the flap is secured to a portion of one or both of the first and second panels. The entire second lateral edge of the flap is secured to a portion of one or both of the first and second panels. The flap is formed of a non-elastic, woven or knit material. An elastomeric member extends along at least a portion of the free edge of the flap. The elastomeric member biases the flap toward the interior surface of one of the first and second panels to at least partially surround and secure one of a pillow and a cushion within the cavity. The elastomeric member biases the first lateral edge of each the first and second panels toward the second lateral edge of each of the first and second panels to secure one of a pillow and a cushion within the cavity.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
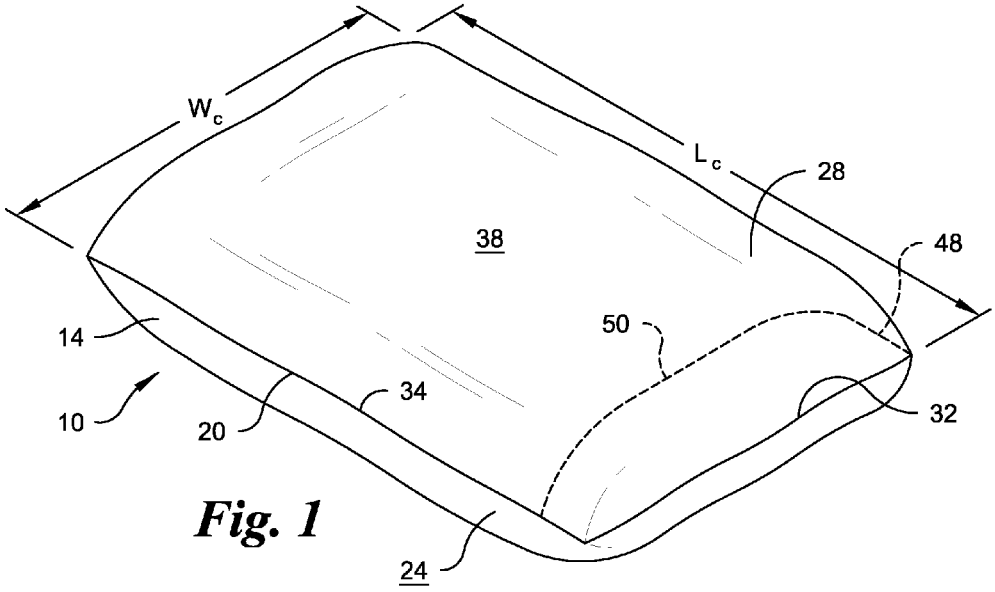
FIG. 1 is a bottom perspective view of a cover for a pillow or cushion according to a first preferred embodiment of the present invention.

Certain terminology is used in the following description for convenience only and is not limiting. The words "bottom" and "top" designate directions in the drawings to which reference is made. The words "inwardly" and "outwardly" refer to directions toward and away from, respectively, the geometric center of the cover, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout, FIGS. 1-4 show a cover, generally designated 10, for a pillow 12, cushion or the like according to a first preferred embodiment of the present invention. The cover 10 has a length $L_C$ and a width $W_C$ measured generally perpendicularly to the length $L_C$. The cover 10 is illustrated as a generally rectangular structure when viewed from above or below, and is capable of being at least slightly expanded to receive the entire pillow 12 therein. In other words, a thickness or height $H_C$ of the cover 10, which is preferably measured generally perpendicularly to both the length $L_C$ and the width $W_C$ thereof, is preferably variable or adjustable.

The cover 10 is not limited to a rectangular shape, as the collapsed or at least slightly expanded cover 10 may have any of a variety of shapes, such as circular or square, when viewed from above or below. Further, the cover 10 is not limited to enclosing and/or surrounding a pillow 12 or cushion that is of a size and/or shape typically used on a bed (not shown) to support an individual's head during sleep. Instead, the size and/or shape of the pillow 12 or cushion may have any of a variety of forms, such as a relatively small, circular pillow for a sitting chair or a relatively large and thick pillow or cushion that extends across a back or width of a sofa.

Figure 2:
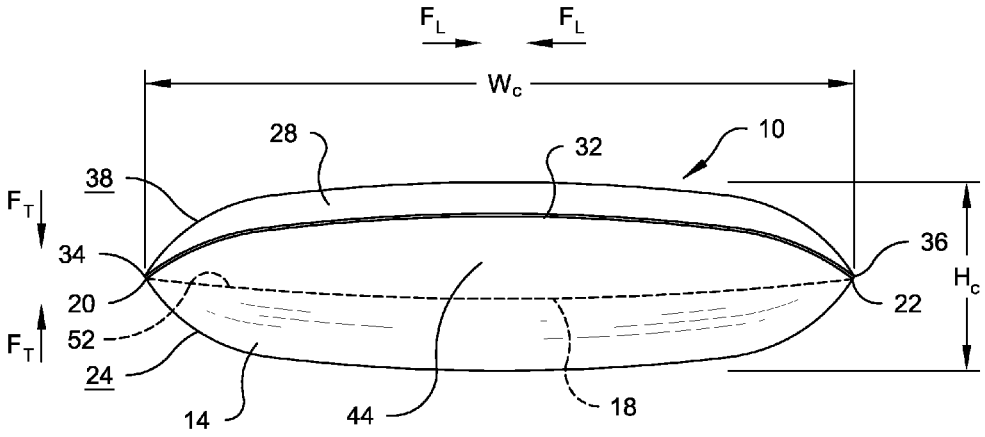
FIG. 2 is a front elevational view thereof.
Figure 3:
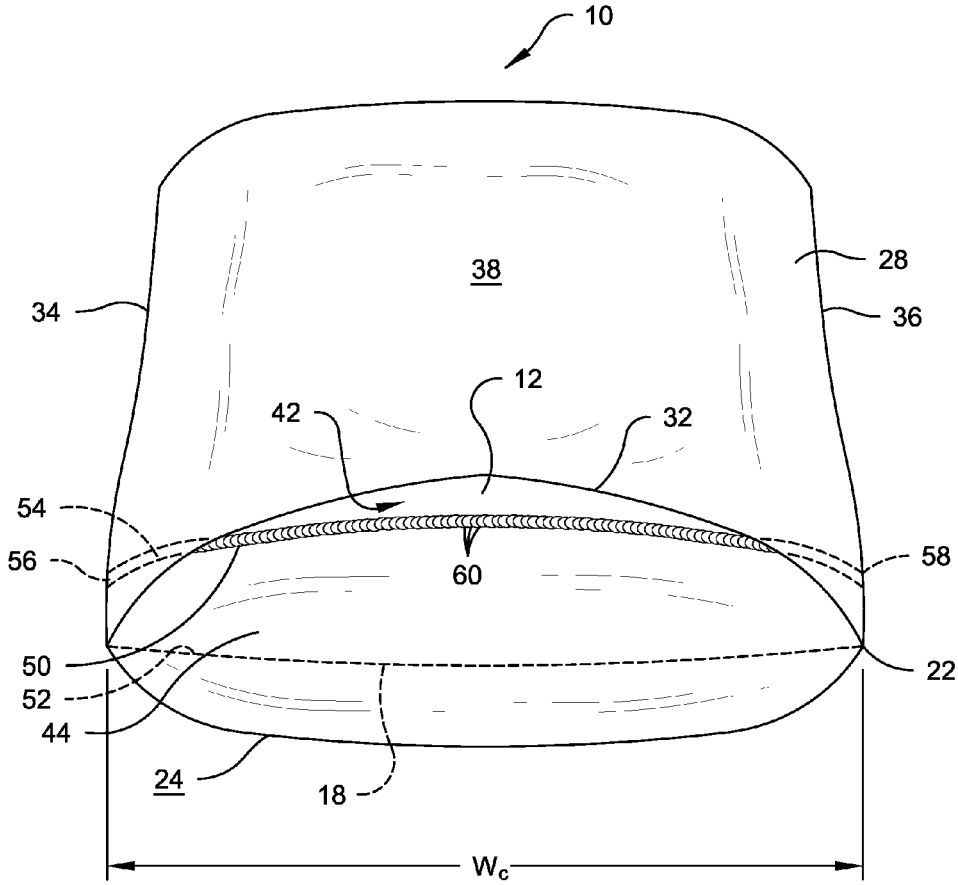
FIG. 3 is a bottom front perspective view thereof, wherein a portion of a second panel is pulled back to expose a portion of a fastener and a pillow or cushion.
Figure 4:
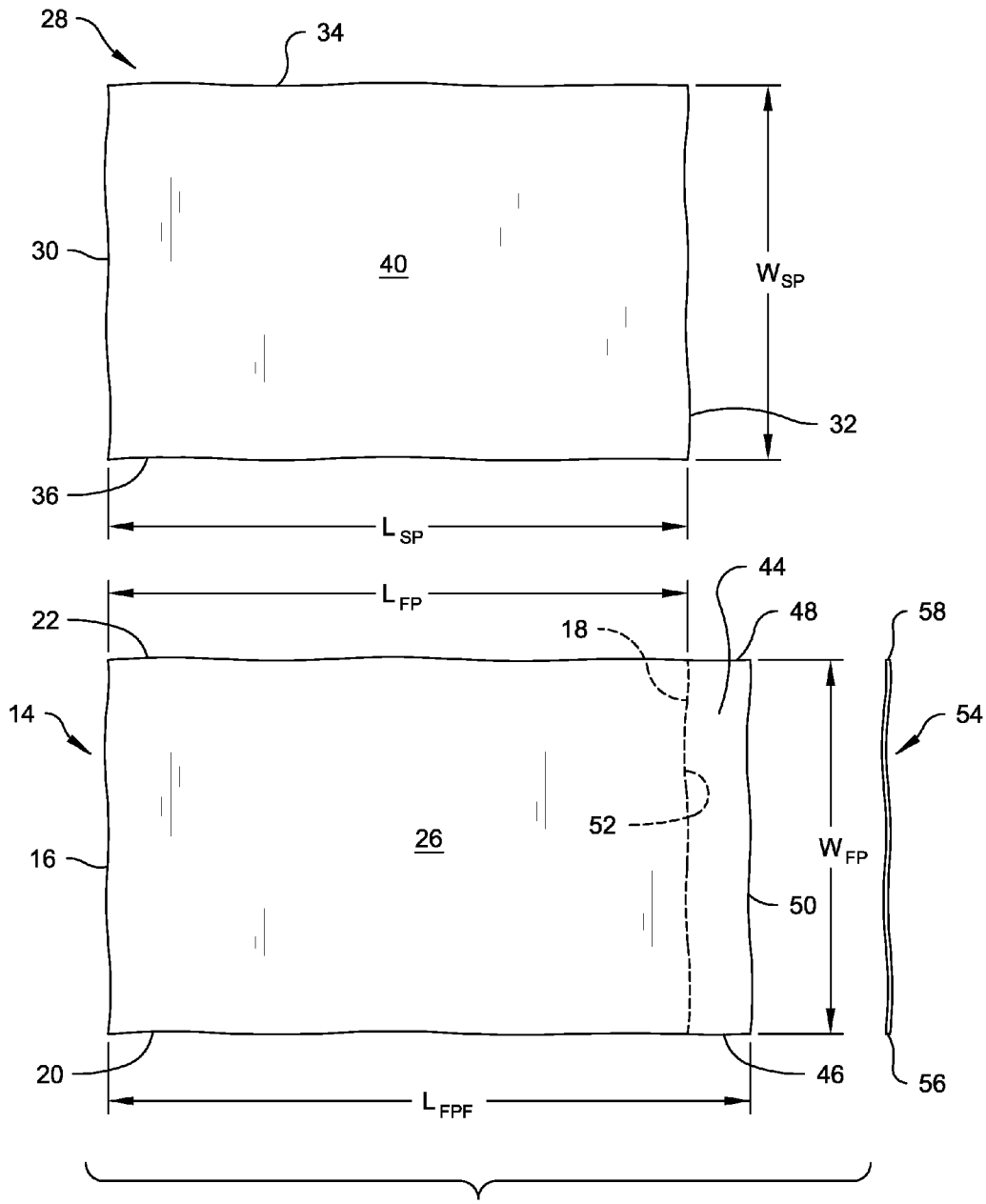
FIG. 4 is an exploded view of the cover of FIG. 1, wherein a first panel, the second panel and the fastener are each shown in a relaxed, non-attached configuration.

Referring to FIGS. 1-4, the cover 10 includes a first or top panel 14 having a first end edge 16, an opposing second edge 18, a first lateral edge 20 and an opposing second lateral edge 22. The combined first end edge 16, the second end edge 18, the first lateral edge 20 and the second lateral edge 22 define an outer periphery of the first panel 14. The first panel 14 also includes an exterior surface 24 and an opposing interior surface 26. As shown in FIG. 4, the first panel 14 is preferably generally flat or planar when in a relaxed and/or non-stretched, pre-attached configuration. The first panel 14 is preferably at least generally rectangular in shape when viewed from above or below (FIG. 4), such that the first end edge 16 extends at least generally perpendicularly to each of the first and second lateral edges 20, 22. However, the first panel 14 may have any of a variety of shapes, such that the first and second end edges 16, 18 may be at least slightly angled or arcuate with respect to each other and/or with respect to either or both of the first and second lateral edges 20, 22. The first panel 14 preferably has a length $L_{FP}$ measured from the first end edge 16 to the second end edge 18. Further, the first panel 14 preferably has a width $W_{FP}$ measured from the first lateral edge 20 to the second lateral edge 22. The length $L_{FP}$ and the width $W_{FP}$ of the first panel 14 are preferably generally, if not exactly, the same dimensions as the length $L_C$ and the width $W_C$, respectively, of the cover 10.

Referring again to FIGS. 1-4, the cover 10 includes a second or bottom panel 28 having a first end edge 30, an opposing second end edge 32, a first lateral edge 34 and an opposing second lateral edge 36. The combined first end edge 30, the second end edge 32, the first lateral edge 34 and the second lateral edge 36 define an outer periphery of the second panel 28. The second panel 28 also includes an exterior surface 38 and an opposing interior surface 40. As shown in FIG. 4, the second panel 28 is preferably at least generally rectangular when in a relaxed and/or non-stretched, pre-attached configuration. The second panel 28 is preferably at least generally rectangular in shape when viewed from above or below (FIG. 4), such that the first end edge 30 extends at least generally perpendicularly to each of the first and second lateral edges 34, 36. However, the second panel 28 may have any of a variety of shapes, such that the first and second end edges 30, 32 may be at least slightly angled or arcuate with respect to each other and/or with respect to one or both of the first and second lateral edges 34, 36. The second panel 28 preferably has a length $L_{SP}$ measured from the first end edge 30 to the second end edge 32. Further, the second panel 28 preferably has a width $W_{SP}$ measured from the first lateral edge 34 to the second lateral edge 36. The length $L_{SP}$ and the width $W_{SP}$ of the second panel 28 are preferably substantially similar or even identical to the length $L_{FP}$ and the width $W_{FP}$, respectively, of the first panel 14.

Preferably, at least a portion of the outer periphery of the second panel 28 is secured or sewn directly to at least a corresponding portion of the outer periphery of the first panel 14. More specifically, the entire first end edge 30 of the second panel 28 is preferably secured or sewn directly to the entire first end edge 16 of the first panel 14. Further, the entire first lateral edge 34 of the second panel 28 is preferably secured or sewn directly to the entire first lateral edge 20 of the first panel 14. Furthermore, the entire second lateral edge 36 of the second panel 28 is preferably secure or sewn directly to the entire second lateral edge 22 of the first panel 14.

Referring to FIG. 3, a cavity 42 is formed between the interior surface 26 of the first panel 14 and the interior surface 40 of the second panel 28. The cavity 42 is preferably expandable and/or collapsible depending upon the relation or position of the first panel 14 with respect to the second panel 28. Expanding the cavity 42 increases the height $H_C$ of the cover 10, and collapsing the cavity 42 decreases the height $H_C$ of the cover 10. The cavity 42 is preferably sized and shaped to receive the entire pillow or cushion 12 therein when at least partially expanded. In the preferred embodiment, the second end edge 18 of the first panel 14 is not attached, sewn or otherwise affixed to any portion the second end edge 32 of the second panel 28. Thus, an opening is formed between the second end edge 18 of the first panel 14 and the second end edge 32 of the second panel 28 for accessing the cavity 42. The opening provides access to the cavity 42 of the cover 10, and allows the pillow or cushion 12 to be inserted into or removed from the cavity 42.

Referring again to FIGS. 1-4, the cover 10 preferably includes a flap 44 that helps to maintain, hold or secure the pillow 12 within the cavity 42 of the cover 10. The flap 44 is preferably a portion of one of the first and second panels 14, 28. More particularly, it is preferred that the flap 44 is a portion of the first panel 14. Alternatively, the flap 44 may be a separate and distinct component that is fixedly or removably secured or sewn to one of the first and second panels 14, 28 and, more particularly, to the first panel 14. The flap 44 is preferably movable from a first position, in which the flap 44 extends outwardly from a portion of the outer periphery of one of the first second panels 14, 28 and outwardly from the cavity 42, and a second position, in which the flap 44 extends inwardly toward and/or into the cavity 42 when the cover 10 is in a fully assembled configuration (see FIGS. 1-3).

The flap 44 preferably includes a first lateral edge 46, an opposing second lateral edge 48 and a free edge 50 that extends from the first lateral edge 46 to the second lateral edge 48. The flap 44 also preferably includes an attached edge 52 that opposes the free edge 50 and extends from the first lateral edge 46 to the second lateral edge 48. As shown in FIG. 4, the flap 44 is preferably at least generally rectangular when in a relaxed and/or non-stretched, pre-attached configuration. The entire attached edge 52 of the flap 44 is preferably integral with, secured or sewn directly to the second end edge 18, 32 of one of the first and second panels 14, 28. The attached edge 52 of the flap 44 may be a fold line and is preferably positioned at or adjacent to the opening of the cavity 42. The combined first panel 14 and the flap 44 has a length $L_{FPF}$ measured from the first end edge 16 of the first panel 14 to the free edge 50 of the flap 44. As shown in FIG. 4, the length $L_{FPF}$ of the combined first panel 14 and the flap 44, when the flap 44 is in a fully outward position, is preferably greater than the length $L_C$ of the cover 10, the length $_{LFP}$ of the first panel 14 and the length $_{LSP}$ of the second panel 28.

Each of the first and second lateral edges 46, 48 of the flap 44 are preferably secured to a portion of the outer periphery of at least one of the first and second panels 14, 28. More specifically, it is preferred that the entire first lateral edge 46 of the flap 44 is fixedly secured or sewn directly to a portion of one or both of the first and second panels 14, 28, such as at least a portion of one or both of the first lateral edges 20, 34 thereof. Further, it is preferred that the entire second lateral edge 48 of the flap 44 is secured or sewn directly to a portion of one or both of the first and second panels 14, 28, such as at least a portion of one or both of the second lateral edges 22, 36 thereof. Thus, in a preferred embodiment, the flap 44 is maintained in the inward position (FIGS. 1-3) after the cover 10 has been fully assembled, such that a user cannot move the flap 44 from the inward position (FIGS. 1-3) to the outwardly position (FIG. 4) without removing or breaking the attachment or stitching of the first and second lateral edges 46, 48 of the flap 44 with the first and second lateral edges 22, 36 of the first and second panels 14, 28. As such, the cover 10 provides the aesthetic appearance of a conventional cover to a user that does not examine or realize that the flap 44 is included in the cavity 42 of the cover 10.

The first and second panels 14, 28 and the flap 44 are each preferably formed of a non-elastic, woven material. However, the first and second panels 14, 28 and the flap 44 are not limited to being formed of a woven material. For example, it is possible that one or more of the first and second panels 14, 28 and the flap 44 are formed of a non-woven, knitted material. Further, the first and second panels 14, 28 and the flap 44 are preferably formed of a material that is fluid (i.e., water and air) permeable. Alternatively, at least a portion or the entire first and second panels 14, 28 and/or the flap 44 may be formed of a material that is impermeable to fluid.

Referring to FIGS. 1, 3 and 4, the cover 10 preferably includes at least one fastener 54 to at least partially surround and/or retain at least a portion of the pillow 12 within the cavity 42. In the preferred embodiment, the fastener 54 is a single, continuous elastomeric member, as described in detail below, formed of an elastomeric material that extends across the entire width $W_C$ of the cover 10. However, the fastener 54 is not limited to such a specific configuration, as the fastener 54 may be any of a variety of devices that are capable of removably attaching one item to another. For example, the fastener 54 may be two or more elastomeric members extending in series and/or in parallel across the width $W_C$ of the cover 10. Alternatively or additionally, the fastener 54 may include one or more equidistantly spaced-apart hook-and-loop type fasteners proximate the free end 50 of the flap 44 that directly engage one or more hook-and-loop type fasteners fixed to an exterior surface of the pillow 12. Alternatively or additionally, the fastener 54 may include one or more equidistantly spaced-apart buttons or slots proximate the free end 50 of the flap 44 that receive one or more corresponding slots or buttons of the pillow 12.

In the preferred embodiment, the elastomeric member 54 preferably extends along or approximate to the entire free edge 50 of the flap 44 from the first lateral edge 46 to the second lateral edge 48 thereof. More specifically, a first end 56 of the elastomeric member 54 is preferably fixed or sewn directly to a portion of the outer periphery of one or both of the first and second panels 14, 28, such as the first lateral edge 20, 34, respectively. Similarly, it is preferred that an opposing second end 58 of the elastomeric member is fixed or sewn directly to another portion of the outer periphery of one or both of the first and second panels 14, 28, such as the second lateral edge 22, 36.

Figure 5:
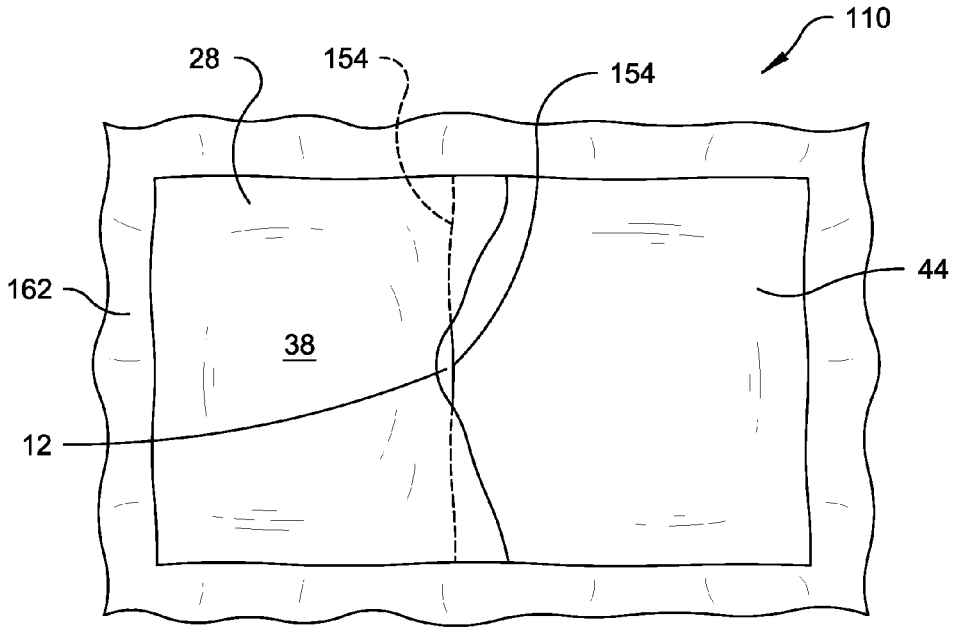
FIG. 5 is a top plan view of a cover for a pillow or cushion according to a second preferred embodiment of the present invention.

In the first preferred embodiment shown in FIGS. 1-4, the elastomeric member 54 is preferably positioned proximate to one edge of the cover 10, such as at or closer to the second end edges 18, 32 as opposed to the first end edges 16, 30. In such a configuration, the cover 10 is preferably a pillow case. However, a second preferred embodiment of the cover 110, which is substantially similar to the first preferred embodiment and shown in FIG. 5, includes the elastomeric member 154 proximate a midsection thereof. In such a configuration, the cover 110 is preferably a sham. Thus, the elastomeric member 54, 154 is not limited to an exact or specific location to function as intended and described herein. In the second preferred embodiment, the cover 110 may include a decorative ruffle, cord and/or flange 162. The description of certain similarities between the first and second preferred embodiments may be omitted herein for the sake of brevity and convenience, and, therefore, is not limiting.

In use, when the pillow 12 is placed within the cavity 42 of the cover 10, 110 and at least a portion of the pillow 12 is positioned between the flap 44 and the interior surface 26 of the first panel 14, the elastomeric member 54, 154 preferably biases at least the free end 50 of the flap 44 toward the interior surface 26 of the first panel 14 to at least partially surround and/or secure the pillow or cushion 12 within the cavity 42. Thus, the elastomeric member 54, 154 preferably biases the flap 44 downwardly in the direction of a thickness force $F_T$, shown in FIG. 2 and described in more detail below, to push at least a portion of the pillow 12 toward the interior surface 26 of the first panel 14. The thickness force $F_T$ is preferably of a sufficient magnitude that a user can relatively easily overcome to pull the elastomeric member 54, 154 and the flap 44 away from the pillow 12 so as to relatively easily remove the pillow 12 from the cavity 42 of the cover 10, 110.

In the first preferred embodiment, it is preferred that the elastomeric member 54 is at least substantially surrounded and/or enclosed by the flap 44. More specifically, the free edge 50 of the flap 44 preferably extends around an entire periphery of the elastomeric member 54 to secure and/or enclose the elastomeric member 54 within the flap 44. As shown in FIG. 3, the elastomeric member 54 preferably creates a series of folds or ridges 60 in the free edge 50 of the flap 44 due to the inherent pull force (i.e., lateral force $F_L$ described below) of the elastomeric member 54 across the width $W_C$ of the cover 10.

In addition to biasing the flap 44 toward or to the interior surface 26, 40 of one of the first and second panels 14, 28 to secure and/or hold at least a portion of the pillow 12 therebetween, the elastomeric member 54, 154 also preferably biases each of the first lateral edges 20, 34 toward the second lateral edges 22, 36 to secure and/or hold the pillow 12 therebetween. In other words, as shown in FIG. 2, the elastomeric member 54, 154 preferably creates forces in two separate and generally perpendicular planes or directions, namely the lateral force $F_L$ inwardly in the direction of the width $W_C$ of the cover 10 and the thickness force $F_T$ inwardly in the direction of the height $H_C$ of the cover 10, so as to secure and/or hold the pillow 12 within the cavity 42 of the cover 10, 110. The multi-directional force created by the elastomeric member 54 helps to maintain the pillow 12 within the cavity 42 of the cover 10, 110 and in the desired and/or proper position, which reduces or eliminates inadvertent removal and/or misalignment that is common with conventional covers.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A cover for a pillow or cushion, the cover comprising:

a generally planar first panel having an exterior surface and an opposing interior surface;

a generally planar second panel having an exterior surface and an opposing interior surface, at least a portion of an outer periphery of the second panel being secured to at least a corresponding portion of an outer periphery of the first panel to form a cavity between the interior surface of the first panel and the interior surface of the second panel;

a flap extending from a portion of the outer periphery of one of the first and second panels toward the cavity, the flap including a first lateral edge, an opposing second lateral edge and a free edge extending from the first lateral edge to the second lateral edge, each of the first and second lateral edges of the flap being secured to a portion of the outer periphery of at least one of the first and second panels; and at least one fastener proximate the free edge of the flap, the fastener extending generally parallel to the free edge of the flap, the fastener biasing or holding the flap toward the interior surface of one of the first and second panels to at least partially surround and secure one of a pillow and a cushion within the cavity, wherein, when a pillow or cushion is positioned in the cavity, the flap is positioned between an exterior surface of the pillow or cushion and the interior surface of one of the first and second panels; and wherein, when the pillow or cushion is positioned in the cavity, the first panel, the second panel and the flap combine to surround an entire periphery of the pillow or cushion.

2. The cover according to claim 1, wherein the fastener is an elastomeric member extending along the entire free edge of the flap from the first lateral edge to the second lateral edge thereof.

3. The cover according to claim 2, wherein the elastomeric member biases one lateral edge of the cover toward an opposing lateral edge of the cover to secure the pillow or cushion within the cavity.

4. The cover according to claim 3, wherein the elastomeric member creates a biasing force in two separate and generally perpendicular planes.

5. The cover according to claim 4, wherein the first panel and the second panel are formed of a non-elastic, woven or knit material.

6. The cover according to claim 5, wherein the flap is formed of a non-elastic, woven or knit material.

7. The cover according to claim 6, wherein the entire first and second lateral edges of the flap are sewn into a portion of the outer periphery of one or both of the first and second panels.

8. The cover according to claim 7, wherein a first end of the elastomeric member is fixed to a portion of the outer periphery of one or both of the first and second panels, and wherein an opposing second end of the elastomeric member is fixed to another portion of the outer periphery of one or both of the first and second panels.

9. The cover according to claim 8, wherein the flap substantially surrounds the elastomeric member.

10. A cover for a pillow or cushion, the cover comprising:

a generally planar first panel having a first end edge, an opposing second end edge, a first lateral edge, an opposing second lateral edge, an exterior surface and an opposing interior surface, the first panel being formed of a non-elastic, woven or knit material;

a generally planar second panel having a first end edge, an opposing second end edge, a first lateral edge, an opposing second lateral edge, an exterior surface and an opposing interior surface, the entire first end edge of the second panel being secured to the entire first end edge of the first panel, the entire first lateral edge of the second panel being directly secured to the entire first lateral edge of the first panel, the entire second lateral edge of the second panel being directly secured to the entire second lateral edge of the first panel, the second panel being formed of a non-elastic, woven or knit material;

a cavity formed between the interior surface of the first panel and the interior surface of the second panel;

an opening formed between the second end edge of the first panel and the second end edge of the second panel for accessing the cavity;

a flap including a first lateral edge, an opposing second lateral edge, a free edge extending from the first lateral edge to the second lateral edge and an opposing attached edge, the entire attached edge of the flap being integral with or secured to the second end edge of one of the first and second panels, the entire first lateral edge of the flap being secured to a portion of one or both of the first and second panels, the entire second lateral edge of the flap being secured to a portion of one or both of the first and second panels, the flap being formed of a non-elastic, woven or knit material; and at least one elastomeric member extending along at least a portion of the free edge of the flap, the elastomeric member extending along the entire free edge of the flap from the first lateral edge to the second lateral edge thereof, the elastomeric member biasing the flap toward the interior surface of one of the first and second panels to at least partially surround and secure one of a pillow and a cushion within the cavity, the elastomeric member biasing the first lateral edge of each the first and second panels toward the second lateral edge of each of the first and second panels to secure one of a pillow and a cushion within the cavity, wherein, when a pillow or cushion is positioned in the cavity, the first panel, the second panel and the flap combine to surround an entire periphery of the pillow or cushion.

11. The cover according to claim 10, wherein the flap substantially surrounds the elastomeric member.

12. The cover according to claim 11, wherein the entire first lateral edge of the flap is fixedly secured to the first lateral edge of one or both of the first and second panels and the entire second lateral edge of the flap is fixedly secured to the second lateral edge of one or both of the first and second panels.

13. The cover according to claim 12, wherein the elastomeric member creates a biasing force in two separate and generally perpendicular planes.

* * * * *